United States Patent [19]

Knowlton

[11] 4,363,151

[45] Dec. 14, 1982

[54] RIDING SWEEPER WITH HIGH DUMP MECHANISM

[75] Inventor: Christopher M. Knowlton, Toledo, Ohio

[73] Assignee: The Scott & Fetzer Company, Lakewood, Ohio

[21] Appl. No.: 244,074

[22] Filed: Mar. 16, 1981

[51] Int. Cl.[3] ..... A47L 11/24

[52] U.S. Cl. ..... 15/83; 298/11; 414/642

[58] Field of Search ..... 15/83–87, 15/340; 298/11; 414/642

[56] References Cited

U.S. PATENT DOCUMENTS

| | | | |
|---|---|---|---|
| 2,684,496 | 7/1954 | Lull | 15/83 |
| 2,917,196 | 12/1959 | Hastings, Jr. | 414/642 |
| 4,173,052 | 11/1979 | Burgoon et al. | 15/83 |

*Primary Examiner*—Edward L. Roberts

*Attorney, Agent, or Firm*—Allen D. Gutchess, Jr.

[57] ABSTRACT

A riding sweeper is provided with a high dump mechanism for a dirt and debris receiving hopper of the sweeper. The dumping mechanism includes tracks located at forward side portions of the sweeper body. A carrier extends between the tracks and has rollers guided therein so that the carrier can move in an upright manner, preferably with the tracks slanting somewhat forwardly. A hopper is mounted on the back of the carrier and moves up and down therewith. A first fluid-operated ram is located between the sweeper body and the carrier for raising and lowering the carrier and the hopper. A second fluid-operated ram is located between the carrier and the hopper for tilting or rotating the hopper in an arcuate path to a dumping position after the carrier has been raised to an upper position. The hopper dumping mechanism includes a hydraulic system with a valve arrangement for stopping broom and vacuum blower motors when the hopper is raised.

10 Claims, 9 Drawing Figures

RIDING SWEEPER WITH HIGH DUMP MECHANISM

This invention relates to a riding sweeper and more particularly to such a sweeper having a mechanism for raising the hopper to an upper position and rotating it forwardly to a dumping position in order to dump or empty it.

A riding sweeper in accordance with the invention has a main drum broom at an intermediate point under the machine with a driver's position located above, at the rear of the sweeper. A hopper is located at a forward portion of the machine and is provided with a rear opening which communicates with the drum broom to receive dirt and debris therefrom. The sweeper has high dumping mechanism for the hopper which raises the hopper to an elevated position above the floor and rotates it so that the hopper may be emptied into a receptacle or the like. More specifically, the high dumping mechanism of the sweeper includes tracks located at forward, side portions of the sweeper body or frame. A carrier extends across the sweeper between the tracks and has rollers received in the tracks to guide the carrier in its up and down movements. The hopper is pivotally mounted on the carrier through arms which are affixed to the hopper and extend forwardly therefrom where they are pivotally connected to the carrier. A fluid-operated ram or other suitable drive means is mounted between the sweeper body or frame and the carrier to raise and lower the carrier in the tracks. A second fluid-operated ram is mounted between the carrier and the hopper to rotate the hopper upwardly and forwardly in an arcuate path after the hopper and carrier have been raised by the first ram. The hopper has a pivoted door at the top which preferably can swing open by gravity when the hopper is in its forward, over-center position.

The fluid-operated rams can be powered by a hydraulic system for the sweeper which also supplies power for hydraulic motors which rotate the main broom and a curb broom along with an impeller of a vacuum blower. The hopper can operate a valve when it is raised and lowered to prevent hydraulic fluid from being supplied to the motors while the hopper is being raised and dumped.

The high dumping mechanism of the hopper is basically simple and maintenance free. It also is designed so that the overall length of the sweeper and the overall wheel base thereof can be kept to a minimum to provide maximum maneuverability for the sweeper.

It is, therefore, a principal object of the invention to provide a riding sweeper with a high dump mechanism for a hopper thereof.

Another object of the invention is to provide a riding sweeper with a high dump mechanism which is relatively compact and minimizes the overall length and wheel base of the sweeper.

Other objects and advantages of the invention will be apparent from the following detailed description of a preferred embodiment thereof, reference being made to the accompanying drawings, in which.

Figure 1:
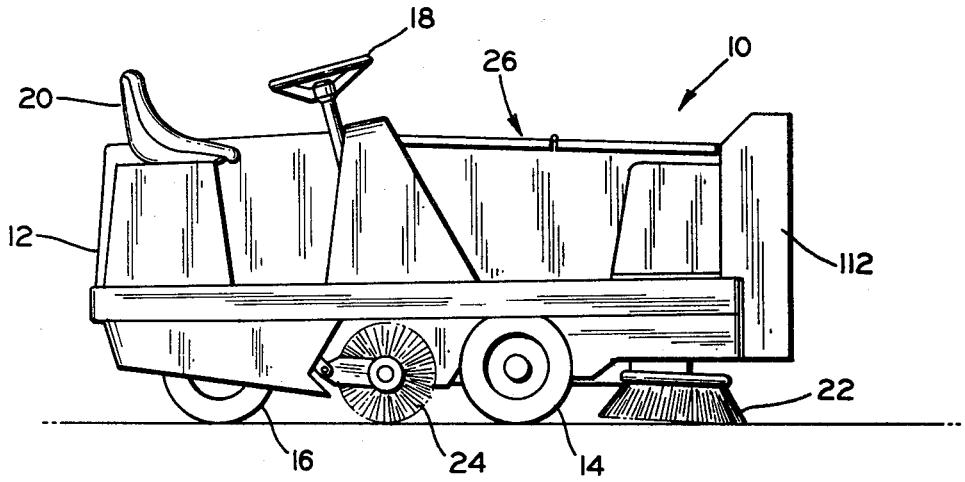
FIG. 1 is a side view in elevation of a riding sweeper embodying the invention.
Figure 2:
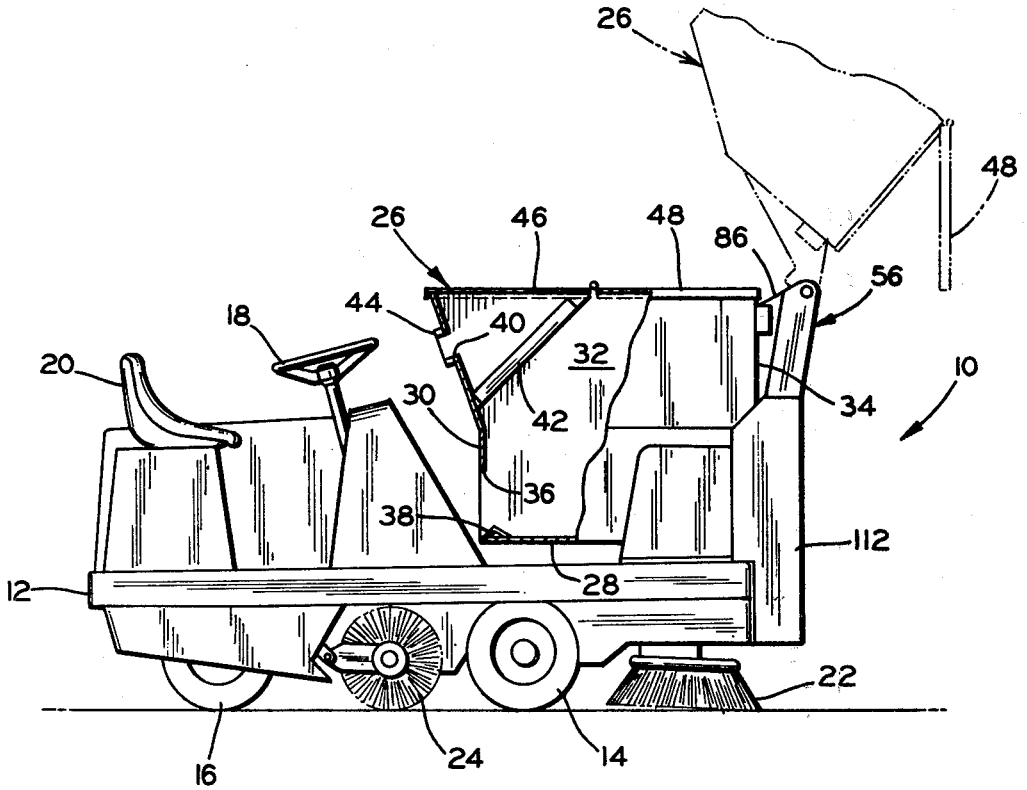
FIG. 2 is a side view in elevation of the riding sweeper with a hopper thereof shown in raised positions.

Referring to the drawings, and particularly to FIGS. 1 and 2, a riding power sweeper embodying the invention is indicated at 10. The machine includes a main frame or body 12 with intermediate wheels 14 and a central, rear wheel 16 which is steered by a steering wheel 18 located in front of a rear operator's seat 20. A curb or side broom 22 can be located in front of the wheels 14, as is known in the art, and a main drum broom 24 is located immediately to the rear of these wheels.

A dirt and debris receiving hopper 26 is located at a forward portion of the machine to receive dirt and debris from the drum broom 24. The hopper has a bottom 28 (FIG. 2), a rear wall 30, side walls 32, and a front wall 34. The rear wall 30 is contoured to fit, in part, with a partition extending across the machine in front of the operator's location. This wall has a rectangular lower opening 36 with a lower lip 38 to receive dirt and debris from the drum broom 24 with the periphery of the opening sealing with rubber flaps on a wall forming a chamber around the main broom. The rear wall 30 also has an upper opening 40 to communicate with a vacuum blower (not shown) which establishes a flow of air and air-borne dirt through the hopper 26 and through a filter 42 therein. The opening 40 has a gasket 44 therearound to seal around an opening in the sweeper partition behind which the blower is located. The hopper also has a rear top 46 and a forward lid 48 openable by gravity, as shown in FIG. 2, when the hopper is in an upper, dumping position.

In many instances, it is advantageous to raise the hopper 26 to an elevated position when emptying or dumping it, as when emptying the contents into a large refuse container, by way of example. One dumping mechanism for accomplishing high dumping of a hopper is shown in Burgoon et al. U.S. Pat. Nos. 4,173,052 and 4,219,901. With the dumping mechanism of those patents, the hopper is moved in a continuous arcuate path from a lower, dirt receiving position to an elevated, dumping position. The contours of some sweepers and hoppers, however, prevent such arcuate movement of the hopper between the two positions.

Figure 4:
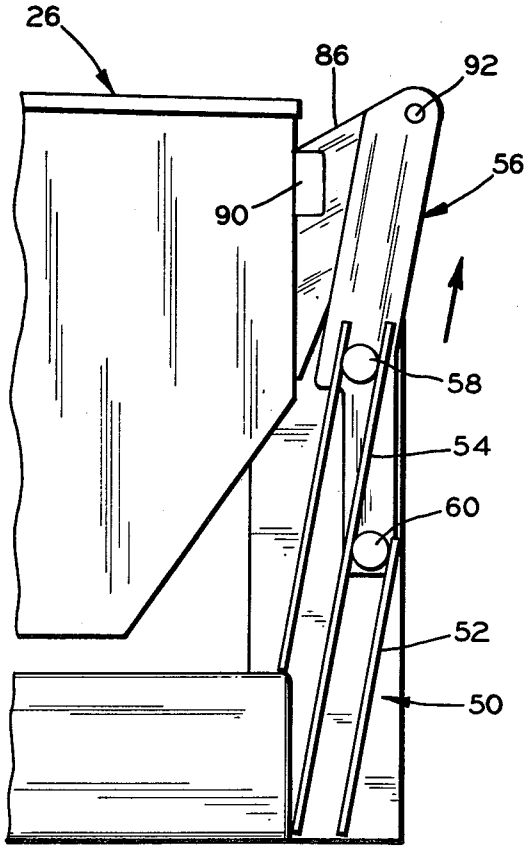
Figure 3:
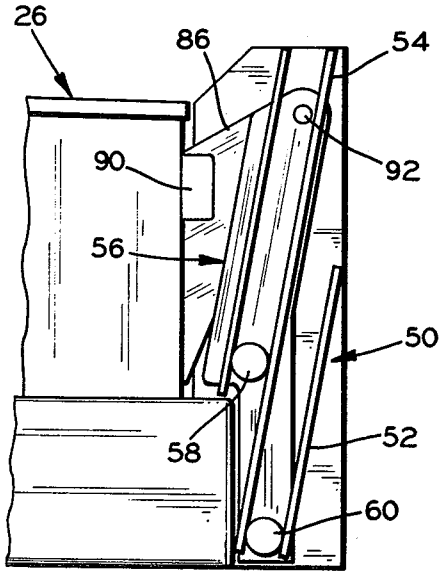
Figure 6:
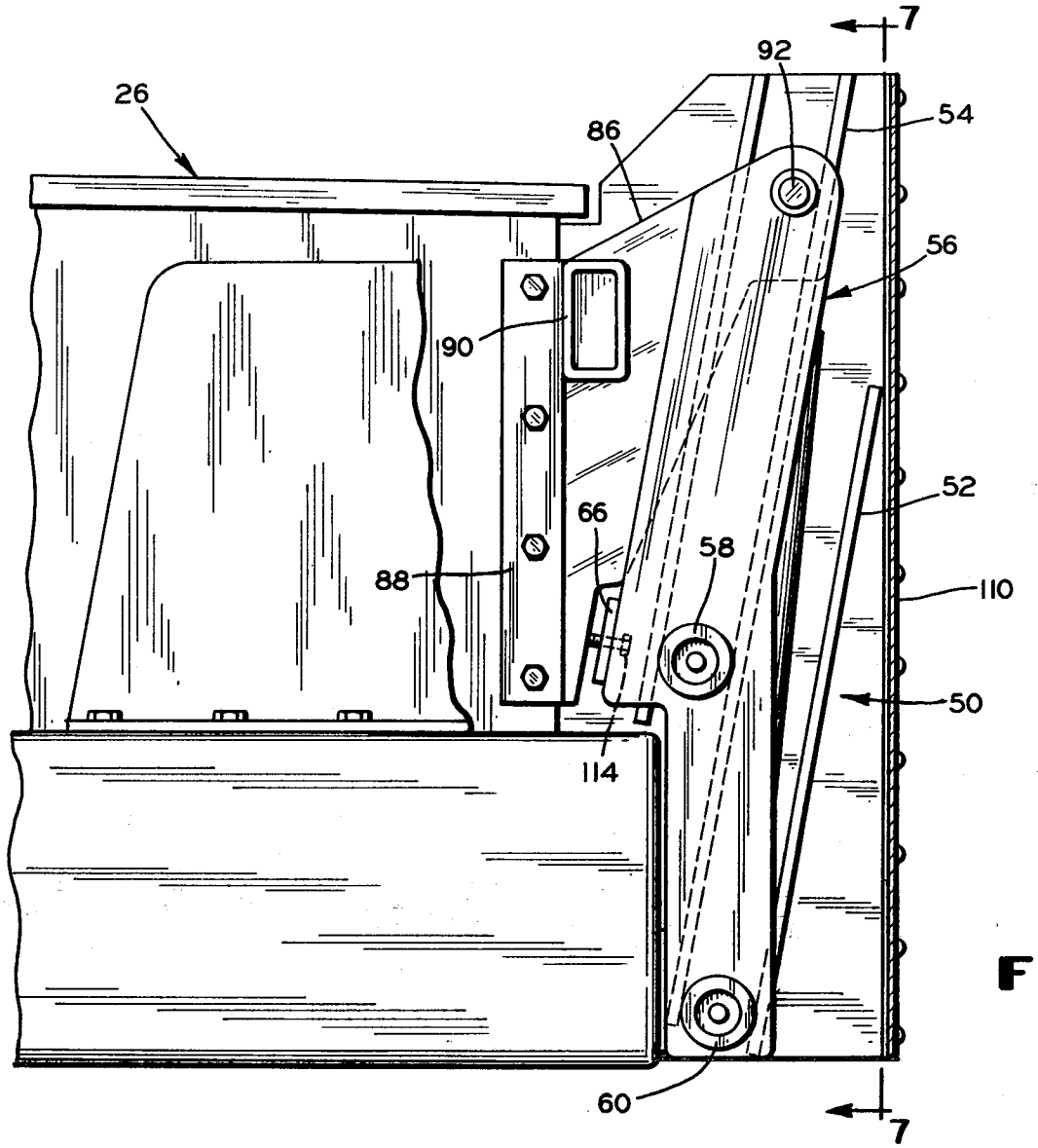
FIG. 6 is a fragmentary side view in elevation, with parts broken away and with parts omitted, of the high dumping mechanism of the sweeper.
Figure 7:
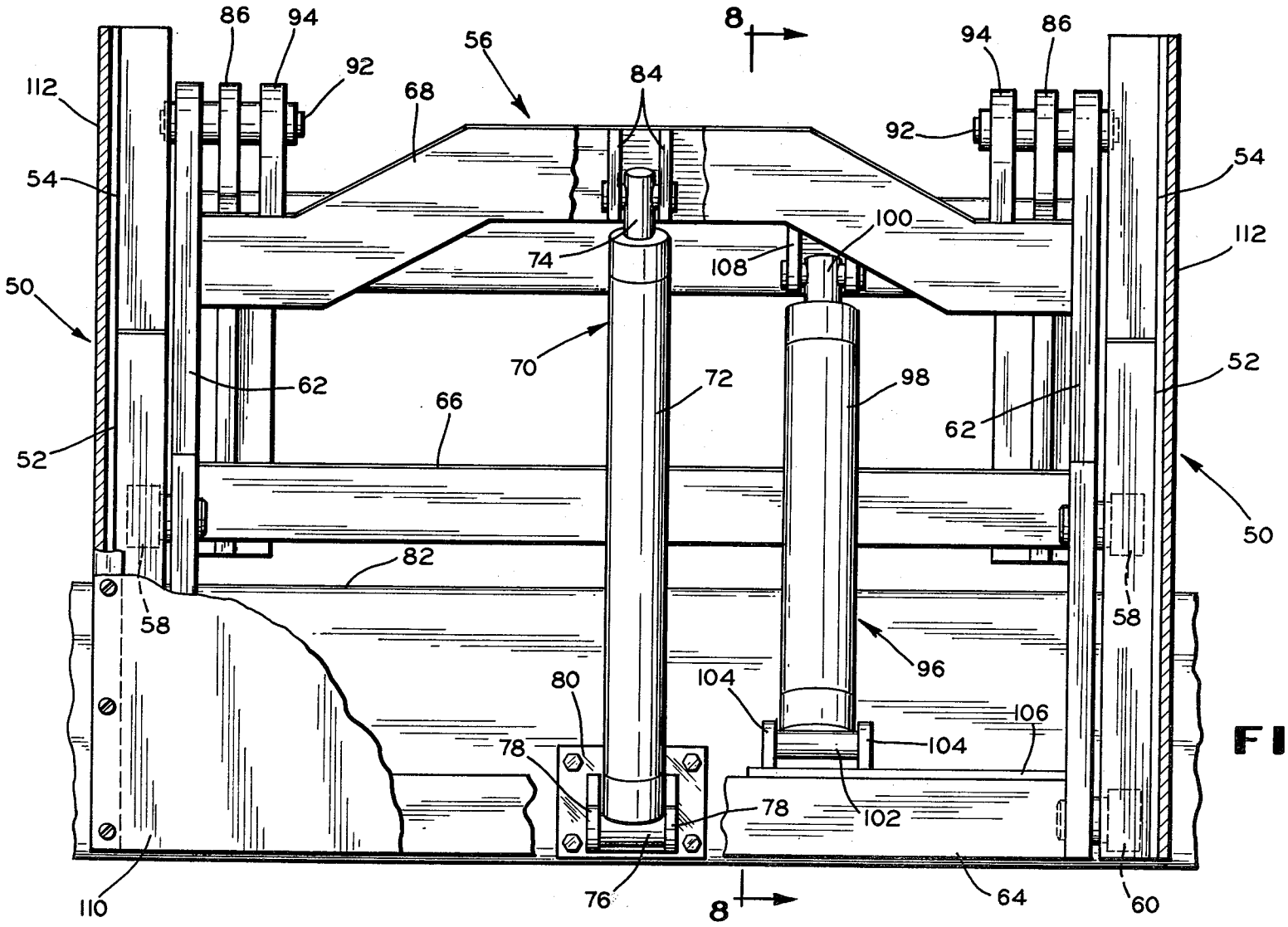
FIG. 7 is a fragmentary view in elevation, with parts broken away and with parts in section, taken generally along the line 7—7 of FIG. 6.

The high dumping mechanism in accordance with the invention enables movement of the hopper 26 from the lower, dirt and debris receiving position to the elevated, dumping, position with hoppers and sweepers of a variety of contours or shapes. Referring to FIGS. 1–5, the dumping mechanism in accordance with the invention first moves the hopper 26 from the lower, dirt and debris receiving position, as shown in FIGS. 1 and 3, in an upright, lineal path which preferably slants so as to have a horizontal component directed forwardly of the machine. With the movement of the hopper being both upward and forward during its initial movement toward the dumping position, the hopper more effectively clears components of the machine and the rubber flaps and the gasket 44 can separate more readily. After the hopper reaches an intermediate position, as shown in FIGS. 2 and 4, it is then moved in an arcuate path to the dumping position, as shown in dotted lines in FIG. 2, and in solid lines in FIG. 5. By the time this arcuate movement occurs, the hopper is sufficiently raised to clear the partition and other components of the sweeper as its arcuate path is initated and continues. In the dumping position, the hopper 26 has to pass an overcenter position to place the forward wall 34 thereof in a downwardly slanted location to facilitate emptying of the dirt therefrom. Also, in this position, the lid 48 can move by gravity to an open position, as shown in FIG. 2.

The high hopper dumping mechanism includes track means 50 located at forward, side portions of the body or frame 12. As shown in FIGS. 3–8, the track means 50 include front tracks or rails 52 and rear tracks or rails 54 which are of generally C-shaped configuration in transverse cross section. The rails are parallel and are in side-by-side relationship throughout at least part of their lengths with the front tracks 52 extending below the rear tracks 54 and the rear tracks 54 extending above the front tracks 52. While single tracks could be employed, the side-by-side disposition of the tracks 52 and 54 provides a more compact design for the sweeper 10, enabling it to be somewhat shorter in overall length and with a shorter wheel base so as to achieve a higher degree of maneuverability.

A carriage 56 extends transversely across the front of the sweeper 10 and has upper rollers 58 received in the rear tracks 54 and lower rollers 60 received in the front tracks 52. The carriage 56 has upright side members or plates 62 which rotatably support the rollers 58 and 60 and also extend substantially above the rollers 58. Several cross struts extend between the side plates 62 to support and hold them in spaced relationship. The cross struts include a lower strut or beam 64 located near the lower ends of the side plates 62, an intermediate cross strut or plate 66 located near the upper rollers 58 and two upper parallel struts or plates 68 located substantially above the rollers 58 but below the upper ends of the elongate plates 62.

Suitable means are employed to raise and lower the carriage 56 in the track means 50 to move the carriage up and down with a forward component when moving upwardly and a rearward component when moving downwardly. As shown, a fluid-operated ram 70 is employed for this purpose, the ram including a cylinder 72 and a piston rod 74 extending upwardly therefrom. The lower end of the cylinder 72 has a pivot block 76 affixed thereto and pivotally connected to ears 78 of a bracket 80. The bracket 80, in turn, is affixed to a transversely-extending box frame member 82 constituting part of the body or frame 12 of the sweeper. The upper end of the piston rod 74 is pivotally connected to a pair of webs or flanges 84 which extend between the parallel cross strut 68 of the carriage 56. When fluid is supplied to the blind end of the cylinder 72, the piston rod 74 is extended and moves the carriage 56 upwardly and forwardly in the tracks 52 and 54. When the pressure in the blind end of the cylinder is relieved, the carriage moves downwardly and rearwardly in the tracks.

The hopper 26 is pivotally carried by the carriage 56 so as to move up and down with the carriage and yet be pivoted to a dumping position relative to the carriage and the tracks. For this purpose, the hopper has two forwardly and upwardly extending arms 86 which are affixed to forward corner portions of the hopper 26 by brackets 88 (FIG. 6) with a box strut 90 extending between and through the arms 86 to provide further strength and maintain them in spaced relationship. The upper, outer ends of the arms 86 are pivotally connected by pins or axles 92 to the upper ends of the side plates 62 of the carriage 56 with the axles 92 further being supported by upwardly-extending flanges or ears 94 (FIG. 7) which are affixed to upper edge portions of the parallel cross struts 68 of the carriage 56.

Figure 5:
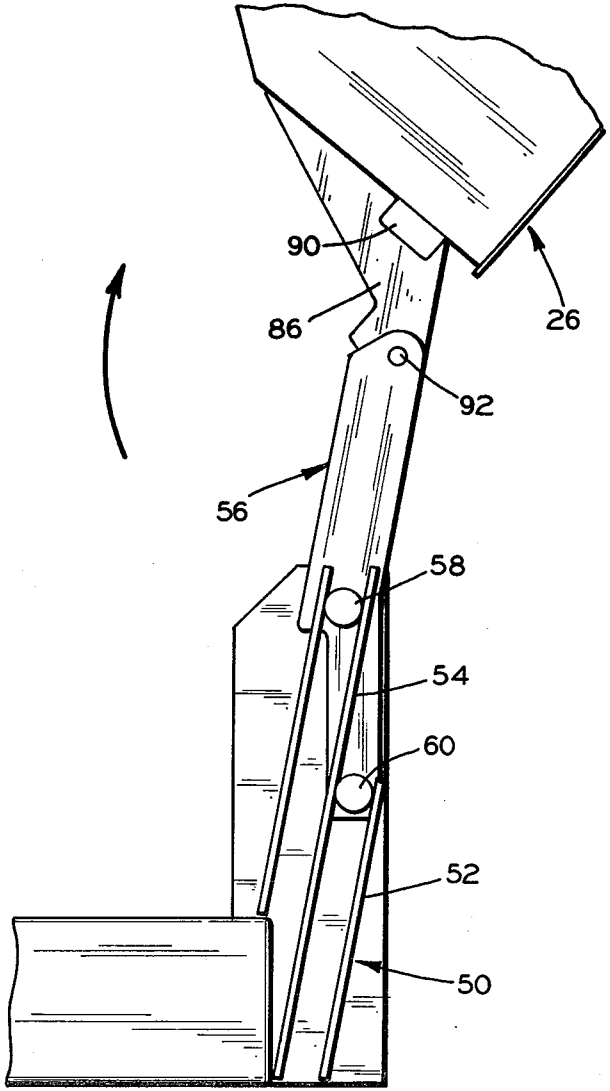
FIGS. 3–5 are fragmentary, schematic side views in elevation of the sweeper hopper and portions of the high dumping mechanisms shown in three successive positions during a dumping operation.

The hopper 26 is rotated relative to the carriage 56 from the position of FIG. 4 to the position of FIG. 5 for dumping the hopper. Suitable drive means are provided to achieve this and, specifically, a fluid-operated ram 96 can be employed. The ram 96 has a cylinder 98 with a piston rod 100 extending upwardly therefrom. The cylinder 98 has a pivot block 102 at the lower end which is pivotally connected to ears 104 which are affixed to an angle iron 106 mounted on a portion of the lower cross strut 64 of the carriage 56. The upper end of the piston rod 100 is pivotally connected to ears 108 which extend forwardly of the box strut 90 between the pivot arms 86. Two of the rams 96 can be employed on each side of the ram 70 for larger sweepers.

When fluid under pressure is supplied to the blind end of the cylinder 98, the piston rod 100 is extended to force the arms 86 upwardly relative to the lower carriage strut 64 and cause the arms to pivot about the axles 92. In the most extended position of the piston rod 100, the hopper is moved over center to the dumping position shown in FIG. 5. To move the hopper 26 down to the upright position of FIG. 4, fluid must be supplied to the rod end of the cylinder 98 in order to move the hopper back over the center position. Reducing the pressure in the blind end of the cylinder 72 then enables the hopper 26 to return to its lower, operating position by gravity. In this position, the hopper can be adjusted relative to the drum broom 24 by means of adjusting bolts 110 which are threaded through the cross strut 66 and engage lower edges of the arms 86.

Suitable front and side panels 112 and 114 can be located around the lifting and dumping mechanism for safety purposes and to achieve an enhanced appearance of the sweeper 10.

Figure 9:
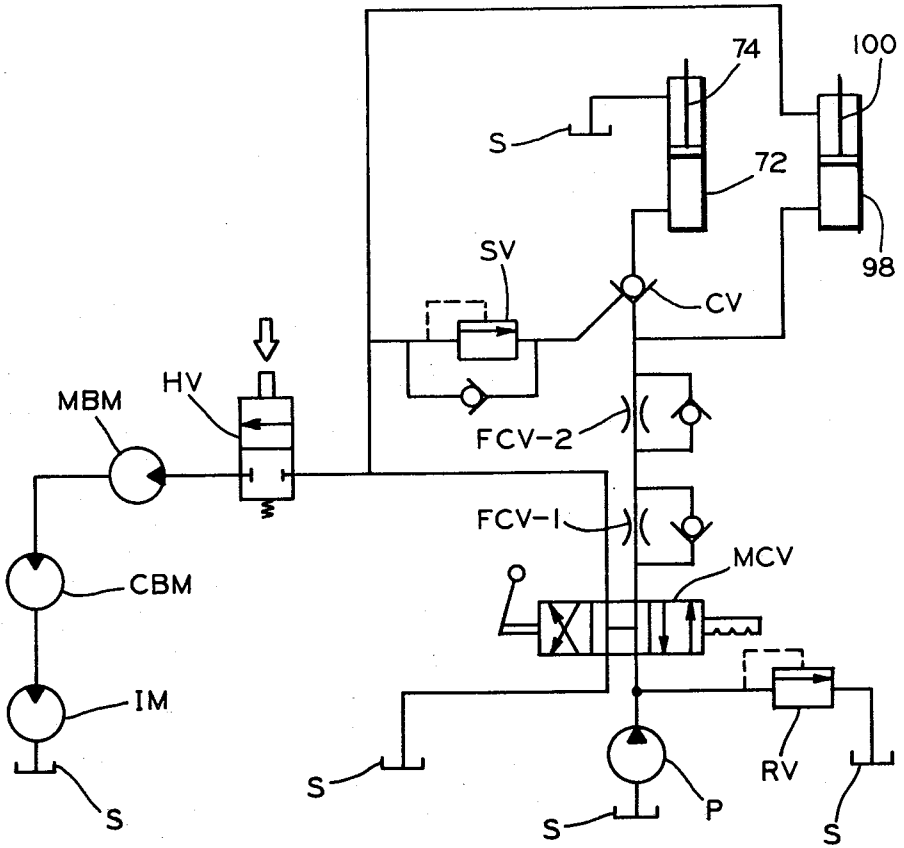
FIG. 9 is a diagrammatic view of the hydraulic system of the riding sweeper.
Figure 8:
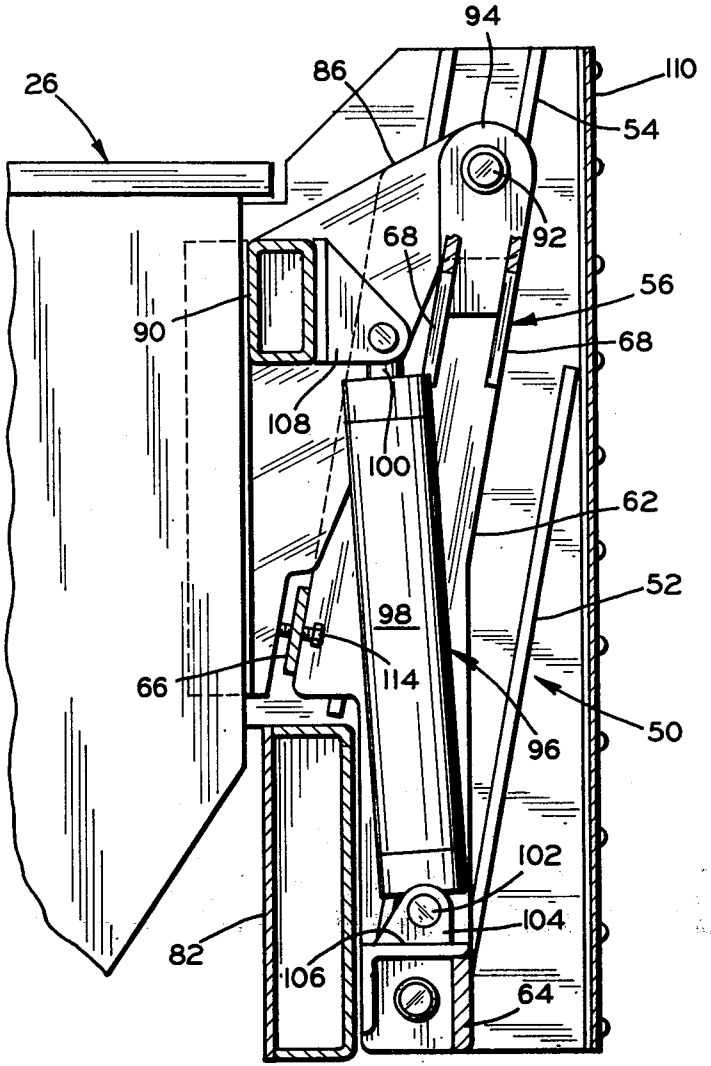
FIG. 8 is a fragmentary view in transverse cross section taken along the line 8—8 of FIG. 7.

The hydraulic system of FIG. 9 controls the operation of the dumping mechanism. When a manually-operated, main control valve MCV is moved to the left position, a pump P supplies oil through two variable, pressure-compensated flow control valves FCV-1 and FCV-2 and through a pilot-operated check valve CV to the blind end of the lift cylinder 72. When the piston rod 74 of the lift cylinder 72 is fully extended, the pressure in the system increases and oil supplied to the blind end of the rotation cylinder 98 extends the piston rod 100 to pivot the hopper 26 over center to the dumping position.

When the main control valve MCV is moved to the right position, the pump P supplies oil to the rod end of the rotation cylinder 98 to retract the piston rod 100 and move the hopper 26 back to its upright position. Increase in the oil pressure then causes a sequence valve SV to open and to supply oil to the check valve CV, thereby unseating it. Oil then returns from the blind end of the cylinder 72 and the hopper is lowered to its operating position.

When the hopper 26 is raised to be dumped, it is moved away from the plunger of a spring-loaded, hopper valve HV and enables it to close. This prevents oil from being supplied to hydraulic motors, including a main broom motor MBM, a curb broom motor CBM, and an impeller motor IM, during the dumping operation. When the hopper reaches its operating position again and engages the plunger, the hopper valve HV is then opened to operate the motors again.

The system also includes a pressure release valve RV and a sump, shown in various places as S.

The main control valve MCV can be left in the right hand position after the hopper is lowered to operate the motors. When the motors are to be stopped, the valve is moved back to the middle or neutral position, as shown. In this position, oil from the pump P is returned to the sump S and pressure in the system can also be relieved through the valve MCV.

Various modifications of the above-described embodiment of the invention will be apparent to those skilled in in the art and it is to be understood that such modifications can be made without departing from the scope of the invention, if they are within the spirit and the tenor of the accompanying claims.

I claim:

1. A surface sweeping machine comprising a body, wheel means for supporting said body on the surface, a rotatable drum broom supported under an intermediate portion of said body, track means at forward, side portions of said body and extending upwardly therefrom, a carriage extending across said body and movably guided by said track means, means connected between said body and said carriage for raising said carriage, a hopper pivotally connected to said carriage, means connected between said hopper and said carriage for pivoting said hopper relative to said carriage, fluid-operated means for rotatably driving said drum broom, a valve controlling the flow of fluid to said fluid-operated means, said valve being engagable by said hopper to be opened when said hopper is in its lowest position and closed when said hopper is raised.

2. A riding-type, surface sweeping machine comprising a body, wheel means for supporting said body on the surface, a rotatable drum broom rotatably supported by said body, at least one track at each forward, side portion of said body and extending upwardly and forwardly therefrom, a carriage extending across said body and movably guided by said track, said machine having means for raising and lowering said carriage, a hopper pivotally connected to said carriage, said machine having means for pivoting said hopper relative to said carriage, drive means for rotating said main broom, and means engagable by said hopper for stopping said drive means when said hopper is in a raised position.

3. A riding-type, surface sweeping machine comprising a body, wheel means for supporting said body on the surface, a rotatable drum broom rotatably supported by said body, at least one track at each forward, side portion of said body and extending upwardly and forwardly therefrom, a carriage extending across said body and movably guided by said track, said machine having means for raising and lowering said carriage, a hopper pivotally connected to said carriage, said machine having means for pivoting said hopper relative to said carriage, fluid-operated means for rotating said drum broom, and a valve engagable by said hopper for stopping a supply of fluid to said fluid-operated means when said hopper is in a raised position.

4. A riding-type, surface sweeping machine comprising a body, wheel means for supporting said body on the surface, a rotatable drum broom rotatably supported by said body, at least one track at each forward, side portion of said body and extending upwardly and forwardly therefrom, a carriage extending across said body and movably guided by said track, said machine having means for raising and lowering said carriage, a hopper pivotally connected to said carriage, said machine having means for pivoting said hopper relative to said carriage, said hopper having a dirt and debris receiving opening at a lower rear portion thereof and having a gravity-openable lid at an upper, forward portion thereof.

5. A surface sweeping machine comprising a body, wheel means for supporting said body on the surface, a rotatable drum broom supported under an intermediate portion of said body, track means at forward, side portions of said body and extending upwardly therefrom, said track means comprising two parallel tracks at each forward, side portion of the body slanting forwardly and at least partially in side-by-side relationship, a carriage extending across said body and movably guided by said track means, means connected between said body and said carriage for raising said carriage, a hopper pivotally connected to said carriage, and means connected between said hopper and said carriage for pivoting said hopper relative to said carriage.

6. A machine according to claim 5 characterized by said carriage having two upper rollers received in corresponding tracks at the forward, side portions of said body and two lower rollers received in the other tracks.

7. A machine according to claim 5 characterized by said tracks comprising a forward track and a rear track at each of the forward, side portions of said body, and said carriage having two upper rollers received in the rear tracks and two lower rollers received in the forward tracks.

8. A riding-type, surface sweeping machine comprising a body, wheel means for supporting said body on the surface, a rotatable drum broom rotatably supported by said body, at least one track at each forward, side portion of said body and extending upwardly and forwardly therefrom, an additional track at each of the forward, side portions of said body and disposed behind said one tracks, a carriage extending across said body and movably guided by said tracks, said machine having means for raising and lowering said carriage, a hopper pivotally connected to said carriage, and said machine having means for pivoting said hopper relative to said carriage.

9. A machine according to claim 8 characterized by said carriage having two rollers received in the one tracks and two rollers received in the additional tracks.

10. A machine according to claim 8 characterized by said carriage having two lower rollers received in the one tracks and two upper rollers received in the additional tracks.

* * * * *